United States Patent [19]

Groendijk

[11] 4,263,544

[45] Apr. 21, 1981

[54] REFERENCE VOLTAGE ARRANGEMENT

[75] Inventor: Hendrik Groendijk, Eindhoven, Netherlands

[73] Assignee: U.S. Philips Corporation, New York, N.Y.

[21] Appl. No.: 23,219

[22] Filed: Mar. 23, 1979

[30] Foreign Application Priority Data

Apr. 5, 1978 [NL] Netherlands ..... 7803607

[51] Int. Cl.[3] ..... G05F 3/08

[52] U.S. Cl. ..... 323/313; 323/907

[58] Field of Search ..... 323/1, 4, 8, 19, 22 T, 323/68–69; 307/296, 297, 310

[56] References Cited

U.S. PATENT DOCUMENTS

| | | | |
|---|---|---|---|
| 3,886,435 | 5/1975 | Steckler | 323/4 |
| 3,916,508 | 11/1975 | Conzelmann et al. | 323/8 X |
| 3,956,661 | 5/1976 | Sakamoto et al. | 323/4 X |
| 4,091,321 | 5/1978 | Hanna | 323/19 |

*Primary Examiner*—J. D. Miller
*Assistant Examiner*—Peter S. Wong
*Attorney, Agent, or Firm*—William J. Streeter; Bernard Franzblau

[57] ABSTRACT

A voltage reference arrangement comprising the series connection of a semiconductor junction and a resistor connected in a current circuit in which a current with a positive temperature coefficient flows. The value of the resistor is such that the voltage across said series connection is highly temperature independent. In order to reduce said temperature-independent voltage, a second resistor is included in said current circuit in parallel with the said series connection and having a resistance value such that the temperature independence of the voltage across said series connection is preserved.

7 Claims, 2 Drawing Figures

REFERENCE VOLTAGE ARRANGEMENT

Figure 1:
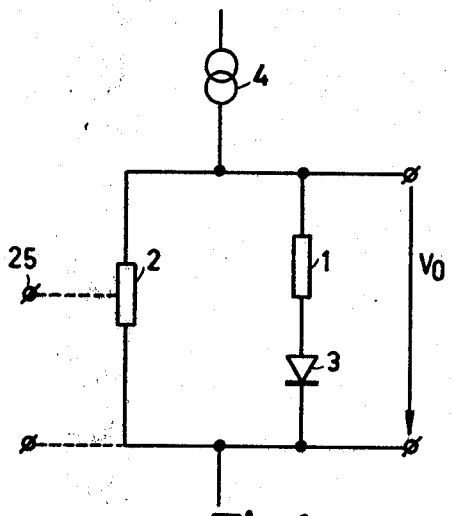

The invention relates to a reference voltage arrangement, comprising a current circuit, means for generating a stabilized current with a positive temperature coefficient in said current circuit, and a semiconductor junction which is included in said current circuit in the forward direction and in series circuit with a first resistor, the resistance value of said resistor being selected with respect to the value of said stabilized current so that if said stabilized current passes through said series circuit of the semiconductor junction and the first resistor, the voltage across said series circuit is highly temperature independent.

Such a circuit arrangement is known from the "IEEE Journal of Solid State Circuits" Vol. Sc.-8, no. 3, June 1973, pages 222–226. In this known arrangement a current with a positive temperature coefficient, in particular a current proportional to the absolute temperature and inversely proportional to a resistance value which is also temperature-dependent, passes through the series connection of a resistor and a diode. If the value of said resistor with respect to the value of said current is such that the voltage across this series connection (circuit) is equal to the band gap voltage of the semiconductor material used for the diode (1.2 V for silicon), said voltage is highly temperature independent. For a different value of said resistor or a different value of said current the voltage is no longer equal to the gap voltage and is no longer temperature independent.

By including n diodes and a resistor having a value which is n times as high in said series connection a temperature independent voltage having a value of n times the gap voltage is obtained.

A drawback of this known circuit arrangement is that the voltage which is obtained is always equal to or an integral multiple of the gap voltage of the semiconductor material which is used. With some of the known circuit arrangements, such as that in accordance with the said publication, the voltage can be reduced with the aid of a voltage divider because reference voltage arrangements have a low output impedance. However, these arrangements are complicated because they include an operational amplifier.

It is an object of the invention to provide a voltage stabilizing arrangement of the type mentioned in the preamble by means of which voltages lower than the gap voltage or integral multiples of the gap voltage can be realized and the invention is characterized in that parallel to the said series connection said current circuit includes a second resistor having a resistance value at which the voltage across the parallel connection of the second resistor and said series connection is higher than the voltage across the semiconductor junction.

The invention is based on the recognition that by virtue of the parallel connection of said second resistor the current through said series circuit decreases, but that the current distribution across said second resistor and said series connection as a function of the temperature is such that the temperature independence of the voltage across this series connection is maintained.

If the first resistor has a value such that the gap voltage appears across said series connection (circuit) without the second resistor and the current through said series connection is reduced, the voltage across said series connection decreases and the temperature independence is eliminated. However, if the current through said series connection is reduced by the parallel connection of a resistor, in accordance with the invention, without changing the value of the first resistor, it is found that the temperature independence of the reduced voltage across said series connection is preserved. The value of said second resistor should be so high that a current is sustained in the series connection and the voltage across said series connection remains higher than the threshold voltage of the semiconductor junction.

A suitable embodiment of a reference voltage arrangement in accordance with the invention is characterized in that the second resistor is a voltage divider.

Since a temperature independent voltage appears across the second resistor, the voltage across each part of said resistor is temperature independent and can be branched off.

Figure 2:
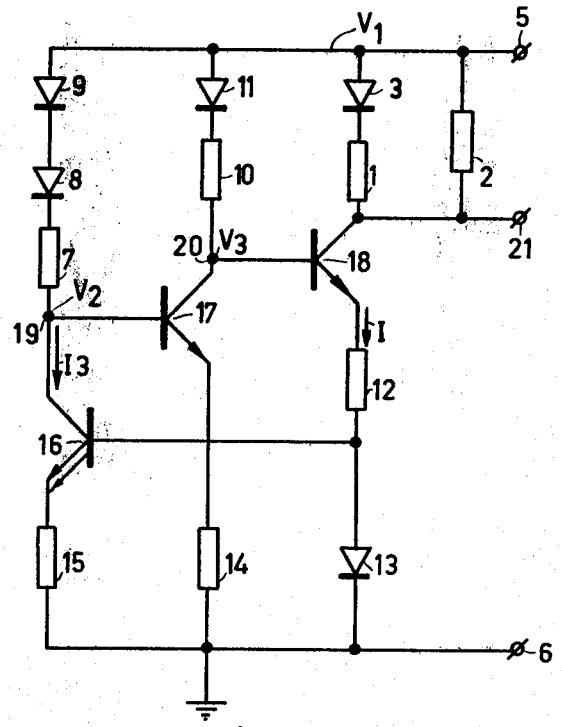

The invention will now be described in more detail with reference to the accompanying drawing in which, FIG. 1 shows the circuit diagram of a reference voltage arrangement in accordance with the invention, and FIG. 2 shows an embodiment of a reference voltage arrangement in accordance with the invention.

The arrangement in accordance with FIG. 1 comprises a current source 4. The current path of said current source 4 includes the series connection of a resistor 1 and a semiconductor junction, in the present example a diode 3. A resistor 2 is included in the current path of the current source 4 in parallel with said series connection.

In the following calculation it is assumed that the current source 4 supplies a current equal to $I=(kT/qR_o)\ln n$, k being Boltzmann's constant. T the absolute temperature, q the absolute value of the electron charge, $R_o$ a resistance value, and n a constant, If the resistor 2 is not included, as in the known circuit arrangements, the following expression is valid for the voltage $V_o$ across the series connection:

$$V_o = IR_1 + V_{be} \tag{1}$$

where $R_1$ is the resistance value of the resistor 1 and $V_{be}$ the voltage across the diode 3.

The publication mentioned in the preamble gives an expression for the temperature dependence of $V_{be}$. With the aid of this expression the following is found for the temperature coefficient of $V_{be}$:

$$\frac{dV_{be}}{dT} = \frac{V_{be} - V_g}{T} - \eta\frac{k}{q} + \frac{kT}{q}\,\frac{1}{I}\,\frac{dI}{dT} \tag{2}$$

where $V_g$ is the gap voltage of the semiconductor material used for diode 3 at 0° K. and $\eta$ is a parameter which is dependent on the semiconductor material.

For the temperature coefficient of the current I the following equation is valid:

$$\frac{dI}{dT} = I\left(\frac{1}{T} - \alpha\right) \tag{3}$$

where $\alpha$ is the temperature coefficient of the resistor $R_o$ (and of resistor 1).

Solving the equation $(dV_o/dT)=0$ yields:

$$IR_1 = V_g - V_{be} + \frac{kT}{q}(\eta - 1 + \alpha T) \tag{4}$$

If for a specific reference temperature $T=T_oR_1$ is selected so that requirement 4 is met, the following applies to $V_o$:

$$V_o = V_g + \frac{kT_o}{q}(\eta - 1 + \alpha T_o) \quad (5)$$

For silicon $V_g=1.205$ V. Furthermore, the value 1.4 may be substituted for $\eta$ and the value 0.002 for $\alpha$ in the case of integrated resistors.

When $T_o=300°$ K. is selected, as a reference temperature, then $V_o$ at $T=T_o$ is:

$$V_o=1.205\ V+0.026\ V.$$

The voltage of 1.205 V is temperature independent, whereas the temperature dependence of the term which at $T=T_o$ is equal to 0.026 V is negligibly small in comparison with the temperature independent voltage of 1.205 V.

If, in accordance with the invention, a resistor 2 of the value $R_2$ is connected in parallel with the series connection of resistor 1 and diode 3, the following applies to $V_o$:

$$V_o=(I-I_1)R_2 \quad (6)$$

where $I_1$ is that part of the current I which flows through the resistor 1 and diode 3.

Assuming that $(dV_o/dT)=0$ then expression (6) yields the following for the temperature dependence of the current $I_1$:

$$(dI_1/dT)=(I/T-I_1\alpha \quad (7)$$

Furthermore:

$$V_o=I_1R_1+V_{be} \quad (8)$$

Assuming that $(dV_o/dT)=0$ in expression (8) with substitution of expression (2) (with $(dI_1/dT)$ instead of $(dI/dT)$, and expression (7), yields the following requirement for temperature independence of $V_o$:

$$IR_1 = V_g - V_{be} + \frac{kT}{q}(\eta - \frac{I}{I_1} + \alpha T) \quad (9)$$

Except for a negligible deviation $(kT/q)(1-(I/I_1))$, this requirement is identical to expression (4). This deviation, compared with the term $V_g-V_{be}$, is negligible if $I_1$ is greater than for example 20% of I.

This means that when resistor 1 in accordance with the expression (4) is selected so that the voltage across the series connection is temperature independent and substantially equal to the gap voltage $V_g$ (without resistor 2), this series connection may be loaded with a parallel resistor 2 so that the voltage $V_o$ decreases, but its temperature independence is maintained.

When the terms $(kT/q)(\eta-1+\alpha T_o)$ and $(kT/q)(1-(I/I_1)$ are neglected, the following requirement is valid for $R_1$:

$$R_1=(V_g-V_{be})/I \quad (10)$$

and the following for the voltage $V_o$:

$$V_o=R_2/(R_1+R_2)V_g \quad (11)$$

If the current I at the reference temperature $T=T_o$ is equal to 1 mA and diode 3 is such that $V_{be}=0.7$ V, a value of 500 Ω for $R_1$ follows from expression (10).

If the voltage $V_o$ should be 1 V, a value of 2500 Ω for $R_2$ follows using expression (11).

By the use of a voltage divider for resistor 2, which is represented by the dashed tapping 25 in FIG. 1, arbitrarily low temperature-independent voltages can be obtained.

FIG. 2 shows an embodiment of the circuit arrangement in accordance with FIG. 1. The arrangement comprises a transistor 16 whose emitter is connected to a power supply terminal, in the present example the ground point of the arrangement, via a resistor 15. The collector of transistor 16, which carries a current $I_3$, is connected to a positive power supply terminal 5 via a resistor 7 and diodes 8 and 9, which terminal carries a voltage $V_1$ relative to ground. The collector 19 of transistor 16, which carries a voltage $V_2$ relative to ground, is connected to the base of a transistor 17, whose emitter is connected to the ground point 6 via a resistor 14 and whose collector is connected to the power supply terminal 5 via resistor 10 and diode 11. The collector 20 of transistor 17, which collector carries a voltage $V_3$ relative to ground, is connected to the base of a transistor 18 which carries a current I. The emitter of transistor 18 is connected to the ground point 6 via resistor 12 and diode 13, diode 13 being included between the base of transistor 16 and ground point 6.

If the ratio of the voltage $V_1-V_2$ across the series connection of diodes 8 and 9 and resistor 7 and the current $I_3$ through said series connection is its d.c. resistance $Z_1$, the following applies to the voltage $V_2$ on the collector of transistor 16.

$$V_2=V_1-I_3Z_1.$$

If the resistance value of resistor 10 is equal to that of resistor 14 the current-voltage characteristics of diode 11 and transistor 17 are identical, the voltage across resistor 10 and diode 11 will be equal to the voltage $V_2$ and the following will apply to the voltage $V_3$:

$$V_3=I_3Z_1.$$

This voltage is independent of the supply voltage $V_1$ if $I_3$ is independent of said voltage.

If the d.c. resistance of the base-emitter junction of transistor 18 in series with resistor 12 and diode 13 is $Z_2$, the following is valid for the current I:

$$I=(V_3/Z_2)=I_3(Z_1/Z_2).$$

If for example $Z_1$ equals $Z_2$ because diode 9 is identical to diode 13, diode 8 to the base-emitter junction of transistor 18, and if the resistance values of the resistors 7 and 12 are equal, then $I=I_3$.

Equality of diode junctions with base-emitter junctions can simply be achieved in integrated circuits by using for the various diodes transistors which are identical to the transistors 17 and 18 and connecting their collectors to their bases.

If the ratio of the currents in diode 13 and transistor 16 at equal base-emitter voltages is $1:n(n>1)$, which can simply be achieved in an integrated circuit by the use of a transistor, connected as a diode, for diode 13, which transistor has an effective emitter area which is n times as small as that of transistor 16, and if the value of resistor 15 is $R_o$, the following applies to the collector current I of transistor 18 (the various base currents being neglected):

$$I=(kT/qR_o)\ln n.$$

This current corresponds to the current adopted for the current source 4 in the arrangement in accordance with FIG. 1.

An advantage of the current source arrangement in accordance with FIG. 2 is that it comprises only transistors of the same conductivity type, in the present example npn-transistors.

The current source as described with reference to FIG. 2 may be extended to a reference voltage source in accordance with the invention by, as is shown in FIG. 2, including in the collector circuit of transistor 18 a resistor 2 parallel to the series connection of resistor 1 and diode 3. The temperature-independent voltage $V_o$ is then available across said resistor 2 for the proper choice of the resistors 1 and 2.

As a current proportional to the temperature may flow through resistors 7 and 12 and the resistors are connected in series with one or more diodes, it is also possible to realize temperature independent voltages by means of said resistors.

For the known reference-voltage sources it was known that a p-fold increase of the gap voltage $V_g$ can be obtained by connecting p diodes in series with a resistor having a value which is p-fold of the value necessary to obtain the gap voltage $V_g$. This p-fold increase of the gap voltage $V_g$ can also be reduced by including a resistor in parallel with it.

What is claimed is:

1. A reference voltage arrangement comprising, a current circuit that includes a first resistor connected in series circuit with a semiconductor junction element, means for supplying a stabilized current with a positive temperature coefficient to said current circuit, the semiconductor junction element in said current circuit being connected in the forward direction, the resistance value of said first resistor in relation to the value of said stabilized current being selected so that the flow of said stabilized current through said series circuit of the semiconductor junction element and the first resistor produces a voltage across said series circuit that is highly temperature independent, said current circuit further comprising a second resistor connected parallel to said series circuit, said second resistor having a resistance value such that the voltage across the parallel connection of the second resistor and said series circuit is higher than the voltage across the semiconductor junction element.

2. A reference voltage arrangement as claimed in claim 1 wherein the second resistor comprises a voltage divider.

3. A voltage regulator which supplies a substantially constant voltage over a range of operating temperatures comprising, a current circuit comprising a semiconductor junction element connected in series circuit with a first resistor and a second resistor connected in parallel with said series circuit, a current source coupled to the current circuit for supplying a stabilized current with a positive temperature coefficient to the current circuit in the forward direction of the semiconductor junction element, said first resistor having a resistance value chosen to produce a temperature independent voltage across the series circuit for a given value of stabilized current flow in the series circuit, and wherein said second resistor has a resistance value chosen so that the voltage across the current circuit is higher than the threshold voltage of the semiconductor junction element, and a pair of output terminals connected across the current circuit to derive a temperature independent output voltage at said output terminals.

4. A voltage regulator as claimed in claim 3 wherein the first resistor has a resistance value $R_1$ that satisfies the expression:

$$R_1=(V_g-V_{be})/I$$

where $V_g$ is the band gap voltage of the semiconductor material of the semiconductor junction element, $V_{be}$ is the forward voltage across said semiconductor junction element and I is the current supplied to the current circuit by the current source, and wherein the second resistor has a resistance value $R_2$ that satisfies the expression:

$$R_2=V_oR_1/(V_g-V_o)$$

where $V_o$ is the desired output voltage at said pair of output terminals.

5. A voltage regulator as claimed in claim 3 wherein the second resistor comprises a voltage divider and the output voltage at the output terminals is determined substantially solely by the ratio of said first and second resistors and the value of the band gap voltage of the semiconductor material of said semiconductor junction element.

6. A voltage regulator as claimed in claim 3 wherein said current source comprises, first and second terminals for connection to a source of d.c. supply voltage, a first diode, a first resistance means and a first transistor connected in a first series circuit across said first and second terminals, a second diode, a second resistance means and a second transistor connected in a series circuit across said first and second terminals, means connecting a third transistor, a third diode and a third resistance means in a third series circuit, means connecting control electrodes of the second and third transistors to output electrodes of the first and second transistors, respectively, means connecting a control electrode of the first transistor to a junction point in said third series circuit, and means connecting said third series circuit in series with said current circuit across said first and second terminals.

7. A voltage regulator as claimed in claim 6 wherein said first, second and third diodes and the semiconductor junction element are all connected in the forward direction with respect to the d.c. supply voltage.

* * * * *